United States Patent [19]

Harris

[11] 4,314,466

[45] Feb. 9, 1982

[54] HANDCUFF IMPROVEMENTS

[75] Inventor: James E. Harris, Gaithersburg, Md.

[73] Assignee: The United States of America as represented by the Secretary of Commerce, Washington, D.C.

[21] Appl. No.: 126,591

[22] Filed: Mar. 3, 1980

[51] Int. Cl.[3] ..... E05B 75/00

[52] U.S. Cl. ..... 70/16

[58] Field of Search ..... 70/16, 15, 14, 17, 18, 70/19; 119/128

[56] References Cited

U.S. PATENT DOCUMENTS

| | | | |
|---|---|---|---|
| 1,572,262 | 2/1926 | Abbenzeller | 70/16 |
| 1,872,857 | 8/1932 | Wesson | 70/16 |
| 1,984,677 | 12/1934 | Harrington | 70/16 |
| 2,390,885 | 12/1945 | Kelley | 70/16 |
| 2,759,349 | 8/1956 | McKee | 70/16 |

FOREIGN PATENT DOCUMENTS

| | | | |
|---|---|---|---|
| 372619 | 5/1932 | United Kingdom | 70/16 |

*Primary Examiner*—Robert L. Wolfe

*Attorney, Agent, or Firm*—Eugene J. Pawlikowski; Alvin J. Englert

[57] ABSTRACT

Triple locking handcuffs are provided having a lock which has an abutment therein which pushes against a bolt in the lock to double lock the latch and triple lock the ratchet and pawl of the lock. In the triple locked position a biasing means forces the bolt against the abutment, and to unlock the handcuffs a number of different mechanical means are provided for moving the bolt slightly away from the abutment, whereupon the ordinary handcuff key can be used to unlock the handcuffs. Handcuffs are also provided which automatically double and triple lock upon application to the wrist.

17 Claims, 7 Drawing Figures

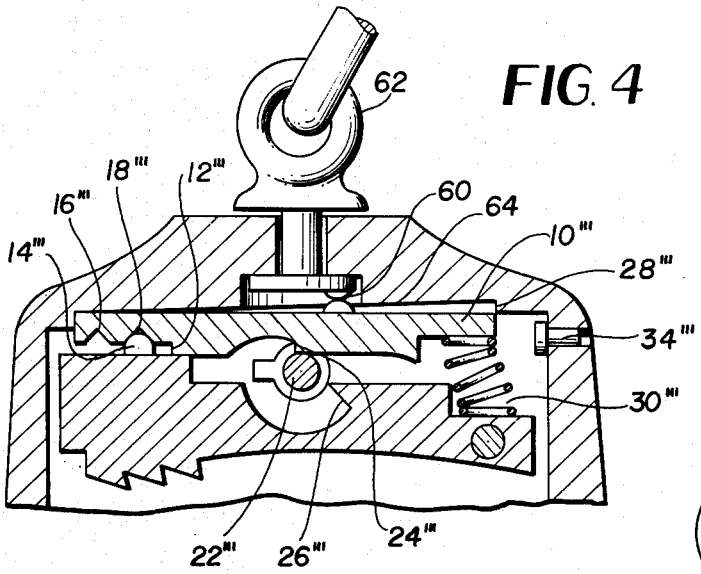
FIG. 4
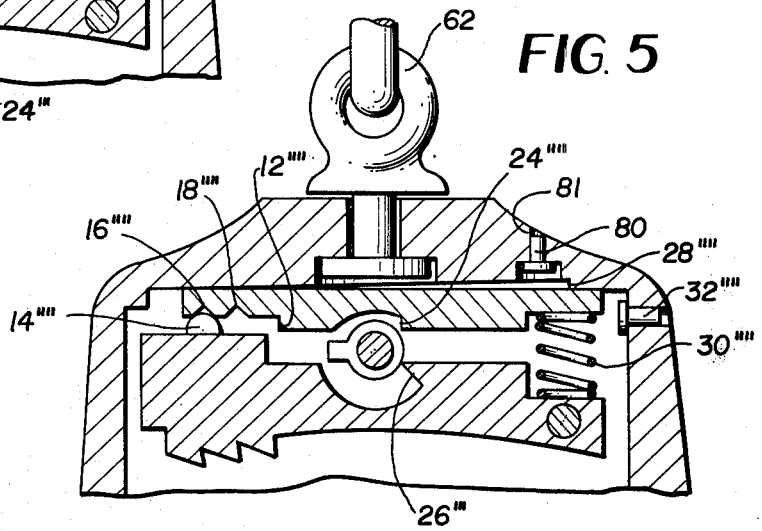
FIG. 5
FIG. 6
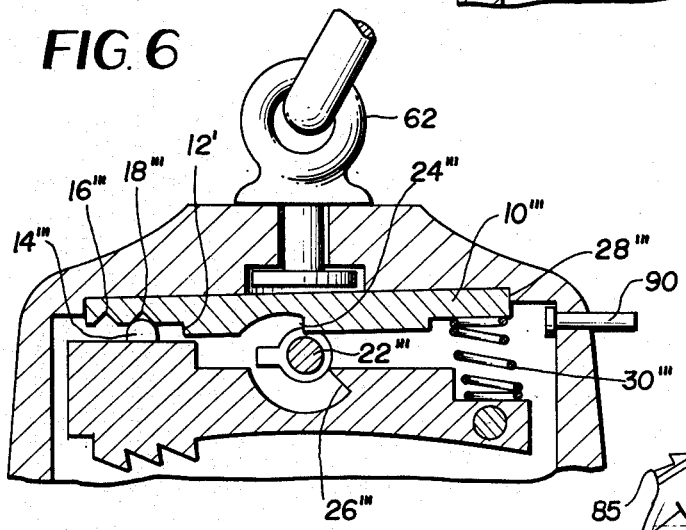
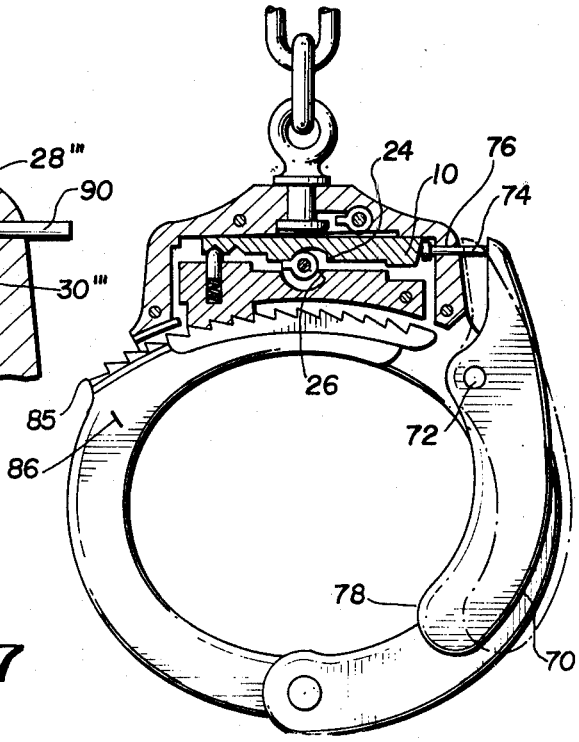
FIG. 7

HANDCUFF IMPROVEMENTS

The present invention is directed to improvements in handcuffs, and more particularly to arrangements providing for the automatic triple locking of such devices.

The conventional handcuffs in common use today include a double locking mechanism. The lock on such handcuffs is ordinarily attached to one of a pair of arcuate locking arms and includes a pawl which is formed in one surface of a relatively elongated latch member. The other arcuate locking arm has ratchet teeth disposed therein which cooperate with the pawl upon insertion of the arm into the lock. The most popular form of double locking mechanism employed with such handcuffs is comprised of a slidable bolt adjacent to the latch, which is moveable from an undouble locked position in which the bolt is physically separated from the latch member to a double locked position in which a shoulder on the bolt overlies the latch member and double locks the ratchet teeth. The bolt is moveable into the double locked position by the police officer who applys the handcuffs by inserting a projection on the end of the key, or other elongated object into a hole in the lock and pushing on the bolt. Handcuffs of this type are exemplified in Wesson et al U.S. Pat. No. 1,872,857 and Kelley U.S. Pat. No. 2,390,885.

While such handcuffs are widely used, the need exists for handcuffs having greater resistance to unauthorized attempts at unlocking. For example, if handcuffs of the type described above are physically banged against a hard surface, the bolt may become undouble locked. Also, the lock may be easily opened by one who has gained unauthorized access to a key, and additionally, it is possible that the lock may be picked by a skilled person. While the prior art discloses the concept of an automatically triple locking handcuff in McKee U.S. Pat. No. 2,759,349, the need for other devices exists.

Also, it is desirable to provide handcuffs which automatically double and triple lock upon application to the wrist. Thus, in the prior art handcuffs described above, in the commotion of making an arrest an officer can easily forget to activate the double locking feature and thus apply the handcuffs in a relatively unsecured fashion.

It is thus an object of the invention to provide automatically triple locking handcuffs.

It is a further object of the invention to provide triple locking handcuffs which require some special knowledge to untriple lock.

It is a further object of the invention to provide triple locking handcuffs which require some special skill to untriple lock.

It is still a further object of the invention to provide handcuffs which accomplish the above objects without requiring special locks or locking procedures.

It is still a further object of the invention to provide handcuffs which automatically triple lock upon application to the wrist without the necessity of activating a separate double or triple locking mechanism.

The above objects are accomplished by providing handcuffs having a similar lock in many respects, to that disclosed in the Wesson et al patent discussed above. However, the lock of the present invention includes an abutment therein, and when the bolt is slid from the undouble locked position to the double locked position, the bolt encounters the abutment and is forced against it by a biasing means, thus forming the triple lock.

To untriple lock the handcuffs, a number of arrangements requiring special knowledge and skill to activate are provided for forcing the bolt away from the abutment against the force of the biasing means. With the bolt so held, the key is inserted in the lock and the bolt is undouble locked and the latch is unlocked in conventional fashion. In one embodiment a secondary key is provided for moving the bolt away from the abutment and in other embodiments a mechanical pushing means is used.

To automatically lock the handcuffs upon application to the wrist, a lever arrangement and pusher rod are employed. Upon application of the handcuffs one end of a pivoted lever rotates away from the handcuffs causing the other end thereof to force a pusher rod against the bolt to automatically slide it into the double locked position.

The invention will be better understood by referring to the accompanying drawings in which:

FIG. 4 is a schematic representation of still a further embodiment of the triple locking handcuffs of the present invention.

FIG. 5 is a schematic representation of still a further embodiment of the present invention.

FIG. 6 is a schematic representation which shows the bolt of FIGS. 2 and 5 set in the triple locked position.

FIG. 7 is a schematic representation of an embodiment of the invention which is automatically triple locking upon the application of the handcuffs to the wrist.

Figure 1:
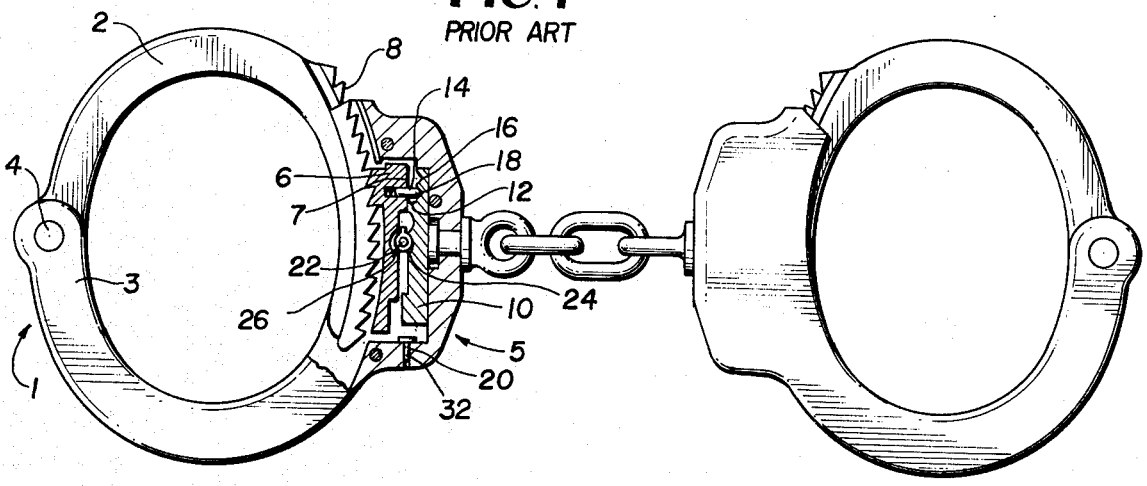
FIG. 1 PRIOR ART
FIG. 1 is a schematic representation of prior art handcuffs having the double locking feature described above.

FIG. 1 is an illustration of conventional double locking handcuffs as are known in the prior art. Handcuff 1 is comprised of arcuate locking arms 2 and 3, arm 2 being pivoted for rotation at pivot means 4. Lock 5 is secured to one end of arm 3 and includes pawl 6 which is formed on the underside of latch member 7. Ratchet teeth 8 are disposed on one end of locking arm 2, and to lock the handcuffs around the wrist of a prisoner or other person, arm 2 is inserted into lock 5 whereupon ratchet teeth 8 cooperate and are locked into pawl 6.

In order to double lock the handcuff, bolt 10 of FIG. 1 is provided. The bolt has shoulder 12 disposed along one surface thereof, and is slidable in the lock housing between an unlocked position in which the shoulder does not contact the latch member, and a locked position which is shown in FIG. 1, in which the shoulder overlies the latch member. The latch member is further provided with a detent 14 for cooperating with two notches 6 and 18 in the bolt, and in the undouble-locked position the detent is caught in notch 16 while in the double-locked position it is caught in notch 18.

The lock housing has a hole 20, and the bolt is moved from the undouble-locked position to the double-locked position by the police officer, who inserts the projection on a key end or other "pushing object" into hole 20 to engage the pusher 32 to push the bolt from the undoubled-locked to the double-locked position.

To unlock the lock, a key is inserted into keyhole 22, and the key is first rotated clockwise to engage ledge 24 of the bolt to slide the bolt into the undouble locked position upon rotation of the key, and the direction of rotation of the key is then reversed to engage ledge 26 of the latch member to lift the pawl from the ratchet, thereby unlocking the handcuff.

While the prior art handcuffs illustrated in FIG. 1 have proven to be serviceable over a period of many years, the degree of security they offer is not always satisfactory. Thus, as mentioned above, by banging the handcuff against a hard surface, it is sometimes possible to loosen the bolt, whereupon the lock is easier to open. Further, it may be possible for a skilled person to pick the lock, or to have a confederate do so.

Figure 2:
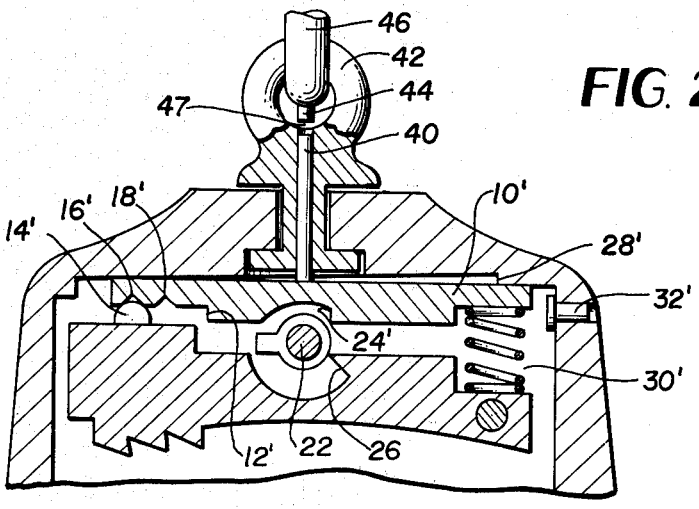
FIG. 2 is a schematic representation of an embodiment of the triple locking handcuffs of the present invention.

In accordance with the present invention, a triple locking arrangement is provided, wherein the lock is automatically triple locked upon being double locked. Several embodiments of the invention are provided, but all have in common a ledge or abutment 28' shown in FIG. 2 and biasing means 30', also shown in that Figure. Referring to FIG. 2, in which the reference numerals corresponding to those of FIG. 1 are used for the same elements, the lock is shown in the undouble locked position with the detent 14' caught in notch 16' of the bolt. Upon movement of the bolt to the left in the figure by pusher 32' which may be displaced by a projection on the police officers key or other means, shoulder 12' overlies the bolt, thus double locking it, and the bolt is moved slightly up against the abutment 28' while biasing means 30' creates an upward force thereon, thus triple locking the lock. Biasing means 30' most conveniently is comprised of a spring means. Also the biasing means may be provided by the spring force within the detent 14'.

The position of the bolt when in the triple locked position is shown in FIG. 6.

To open the lock of the embodiment of FIG. 2, a rod 40 is disposed in a central opening in swivel 42 and may rest upon the top of the bolt 10'. Further, a projection 44 is provided on chain link 46 which is secured to the swivel, and when it is desired to open the lock, the officer engages the projection 44 onto the rod 40 and then pushes the projection down against rod 40, thus causing the bolt to move slightly away from the abutment ledge 28' against the force of biasing means 30', whereupon the key can be inserted into keyhole 22' and the lock can be undouble-locked and unlocked in conventional fashion.

It can be seen that a longer rod 40 can be provided such that the end of the rod extends into the swivel hole 47, and in this case the projection 44 is not required, which facilitates unlocking but which has the effect of decreasing the security of the locking means.

Figure 3:
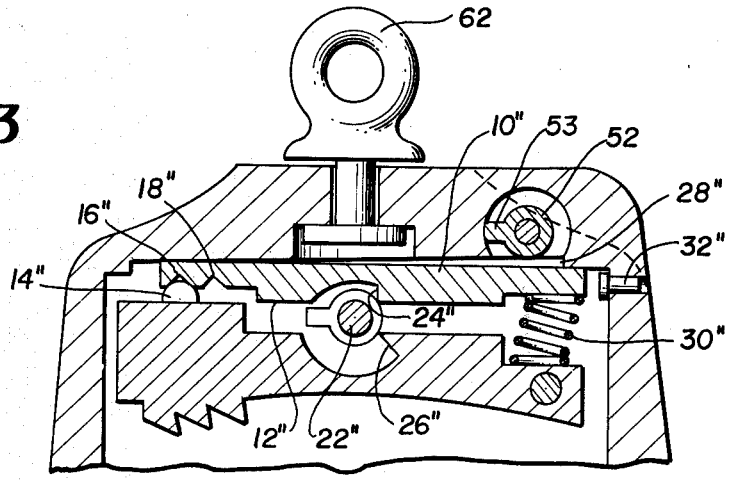
FIG. 3 is a schematic representation of a further embodiment of the triple locking handcuffs of the present invention.

The embodiment of FIG. 3 is similar to that of FIG. 2 except that a secondary key is utilized to force the bolt away from the abutment ledge 28'' to untriple lock the lock. Thus, it is seen that when the secondary key is inserted into the secondary keyhole, the tang 53 of the key 52 is effective to move the bolt 10 away from the abutment ledge 28'' when the key 52 is rotated counter-clockwise. When this is done, the bolt will be moved slightly away from the abutment 28'' against the force of biasing means 30'', and the lock may then be undouble-locked and unlocked by insertion and appropriate rotation of the primary key in keyhole 22''.

In the embodiment shown in FIG. 4, a dimple 60 is provided on the bottom of the swivel 62 for cooperating with another dimple 64 on top of bolt 10''' for use in performing the untriple locking step. Thus, the police officer would rotate swivel 62 to the position where the two dimples overlie each other and the swivel dimple would then press on the bolt dimple 64, thereby causing bolt 10''' to move slightly away from the abutment 28''', whereupon the lock is undouble locked and unlocked in conventional fashion. FIG. 4 illustrates the bolt in the double-locked position in the process of being untriple-locked.

In the embodiment of FIG. 5, a pushing means 80 is provided in hole 81 in the top of the lock, and may be engaged like pusher 32'''', for example, by a projection on the key and pushed down upon the top of the bolt to move it away from abutment ledge 28'''', whereupon the lock may be undouble-locked, and unlocked in conventional fashion.

Thus, several embodiments of triple locking handcuffs have been provided. In each case, some specialized knowledge and skill is necessary to untriple lock, and therefore unlock the devices. Thus, even if a prisoner were to gain access to the key for the handcuffs, he, or his confederate would not be able to open them without possessing the knowledge and the required skill of the specialized opening procedure for each embodiment of the handcuffs. Thus, according to the invention, handcuffs of increased security are provided.

In accordance with a further feature of the present invention, handcuffs which automatically double and triple lock upon application to the wrist are provided, and an embodiment of the invention incorporating this feature is shown in FIG. 7. Referring to that figure, it will be seen that a lever 70 which is secured and pivoted at pivot 72 on one of the locking arms of the handcuff is provided. Additionally, an elongated pusher means 74 is disposed in hole 76 of the lock.

Upon application of the handcuffs to the wrist, the wrist pushes against end 78 of lever 70, thereby causing the lever to rotate counter-clockwise as shown in FIG. 7, thereby pushing against pusher 74 and forcing the bolt 10, to the left to double lock the lock. Since the lock may also include the automatic triple locking feature described above, it will also automatically triple lock upon application to the wrist.

A primary advantage of this automatic locking feature is that the police officer cannot forget to set the double lock as is possible in the handcuffs shown in FIGS. 1–6. Also, with the embodiment of FIG. 5, it is not possible to set the handcuffs too tight, since the double lock becomes set when the lever 70 reaches the proper point of counter-clockwise rotation.

In accordance with a further improvement of the present invention, the last tooth of the ratchet is modified so that it is of reduced slope and has a back edge chamber. This is shown at tooth 85 in FIG. 7, but is a feature which may be used independently of the improvements of FIGS. 2 to 7.

The modified ratchet tooth facilitates finding the last ratchet tooth (in the dark) so that the handcuffs can be stowed in this position. When the last tooth is engaged, it will take less time and force to apply the handcuffs to a subject, thus reducing the chance for a wrist injury, or claims of wrist injury by the subject.

Coined or other "match-up" marks may be made on or adjacent the ratchet and housing to help locate the last ratchet tooth for the above reasons. Such marks would make it easy to visually check if the handcuffs were so stowed. One such mark on the pivoting handcuff arm is illustratively depicted at 86 in FIG. 7.

In accordance with a further improvement of the present invention, a longer pusher 90 illustrated in FIG. 6 is provided. It is designed to extend a small distance from the housing when the bolt is in the inactive or open position such that the pusher may be pushed by hand to move the bolt to the active or double-locked position without the use of a key tip.

Present handcuffs use a short pusher that does not extend to the housing's external surface thereby requiring the use of the key tip or other pin-like object to activate the double lock. This present arrangement makes it relatively difficult for an officer to activate the double lock once a prisoner is handcuffed. This becomes an important problem if the prisoner is hostile or it is dark, when it would be difficult to get the key out, find the pusher hole, engage the pusher and press upon the pusher to activate the double lock. It is important that the length of the pusher 90 be increased only by the minimum amount required, so that the double lock will not inadvertently or maliciously be activated. This improvement is already incorporated with the automatic locking feature shown in FIG. 7, but also may be used independently of the other aspects of the present invention to provide improved handcuff locking.

While certain embodiments of the invention have been described and illustrated, it should be understood that I do not intend to be restricted, thereto, but rather intend to cover all variations, modifications, and uses which come within the spirit of the invention, which is limited only by the claims appended hereto.

What is claimed is:

1. A handcuff which may be triple locked, comprising a pair of pivotable arcuate locking arms which are attached to each other at one end of each arm at a pivot means, one of said arms having a lock including a pawl disposed at the other end of the arm and the other of said arms having ratchet teeth disposed at the other end of the arm for insertion into the lock for engagement with said pawl, said pawl being disposed on part of one side of a latch member, a bolt having a shoulder being disposed in said lock adjacent said latch member and being slidable between an undouble locked position in which said shoulder does not contact said latch member and a double locked position in which said shoulder overlies said latch member and thereby prevents pawl motion, said latch member and said bolt each having shaped portions including respective ledges and said lock having a keyhole through which a key may be passed and caused to engage said ledges during motion for unlocking said bolt and said latch member, and said lock further having an abutment in the interior thereof and a biasing means for forcing said bolt against said abutment when said bolt is in said double locked position to automatically triple lock said lock, and means for moving said bolt away from said abutment against the force of said biasing means for untriple locking said lock, whereupon said key may be used to undouble lock and unlock said lock.

2. The handcuff of claim 1, wherein said latch member has a detent disposed on a surface which is opposite said pawl, and wherein said bolt has at least one notch disposed therein for cooperating with said detent.

3. The handcuff of claim 2, wherein said biasing means comprises a spring.

4. The handcuff of claim 1, wherein said means for moving said latch away from said abutment comprises a second key, said lock having a secondary keyhole for insertion of said second key.

5. The handcuff of claim 1, wherein said means for moving said latch away from said abutment comprises mechanical pushing means which is mounted in or on said lock for pushing against said bolt in a direction so as to move said bolt clear of said abutment.

6. The handcuff of claim 5, wherein said lock has a swivel secured thereto to which the chain which connects the two handcuffs of a pair of handcuffs is attached, and wherein said mechanical pushing means comprises a projection which is mechanically associated with said swivel.

7. The handcuff of claim 6, wherein said swivel has a cylindrical recess therethrough and wherein said projection comprises a pin which is disposed in said recess, the chain link which is attached to said swivel having a dimple thereon which can be used to push said pin against said bolt.

8. The handcuff of claim 6, wherein said projection comprises a dimple which is disposed on the underside of said swivel.

9. The handcuff of claim 8, wherein said bolt also has a dimple thereon for cooperating with said dimple on said swivel.

10. The handcuff of claim 5, wherein said mechanical pushing means comprises a pushing element which is disposed in a hole in the top part of said lock, said pushing element normally resting on said bolt, and being activated from outside said lock for being pushed against said bolt.

11. The handcuff of claim 10, wherein said pushing element is cylindrical in geometry.

12. The handcuff of claim 1, which is automatically double and triple lockable upon application to the wrist, wherein said lock has a hole therein adjacent one end of said bolt, pusher means extending through said hole adjacent said bolt, and mechanical means displaceable by the wrist upon application of the handcuff thereto for causing said pusher means to push said bolt to slide it into the double and triple locked positions.

13. The handcuff of claim 12, wherein said mechanical means comprises a lever which is pivoted at one of said arms, said pusher means being disposed adjacent one end of said lever and said wrist pushing against the other end of said lever upon application of said handcuff causing said one end of said lever to push against said pusher means.

14. In a handcuff comprising a pair of pivotable arcuate locking arms which are attached to each other at one end of each arm at a pivot means, one of said arms having a lock including a pawl disposed at the other end of the arm and the other of said arms having a plurality of ratchet teeth disposed near the other end of the arm for insertion in one direction into the lock for engagement with said pawl, said plurality of ratchet teeth including a first ratchet tooth nearest said other end and a last ratchet tooth further from said other end, said pawl being disposed on part of one side of a latch means for locking said pawl and ratchet, the improvement wherein said last ratchet tooth has a trailing edge of reduced slope in comparison to the other of said ratchet teeth to permit said last ratchet tooth to be inserted in the reverse direction into said lock for engagement with said pawl.

15. In a handcuff which may be double locked, comprising a pair of pivotable arcuate locking arms which are attached to each other at one end of each arm at a pivot means, one of said arms having a lock including a pawl disposed at the other end of the arm and the other of said arms having ratchet teeth disposed at the other end of the arm for insertion into the lock for engagement with said pawl, said pawl being disposed on part of one side of a latch member, a bolt having a shoulder being disposed in said lock adjacent said latch member and being slidable by a pusher means located in a hole in the lock housing between an undouble locked position in which said shoulder does not contact said latch member and a double locked position in which said shoulder overlies said latch member and thereby prevents pawl motion, said latch member and said bolt each having shaped portions including respective ledges and said lock having a keyhole through which a key may be passed and caused to engage said ledges during motion for unlocking said bolt and said latch member, the improvement wherein said pusher means extends outside of said lock housing and is long enough so that it may be pushed by hand without an implement to cause said bolt to be slid to said double locked position.

16. The handcuff of claim 14 wherein said last ratchet tooth has a leading edge of reduced slope in comparison to the other of said ratchet teeth to permit it to readily disengage from said pawl.

17. The handcuff of claim 14 or 15 having match-up marks on said other arcuate locking arm adjacent said last ratchet tooth and on the lock housing respectively to verify that only said last ratchet tooth is in engagement with said pawl.

* * * * *

UNITED STATES PATENT AND TRADEMARK OFFICE

CERTIFICATE OF CORRECTION

PATENT NO. : 4,314,466

DATED : February 9, 1982

INVENTOR(S) : James E. Harris

It is certified that error appears in the above-identified patent and that said Letters Patent are hereby corrected as shown below:

Column 4, line 54, "chamber" should read --chamfer--.

Signed and Sealed this

*Twenty-seventh* Day of *April 1982*

[SEAL]

*Attest:*

GERALD J. MOSSINGHOFF

*Attesting Officer*

*Commissioner of Patents and Trademarks*